US008205662B2

(12) United States Patent
Girgensohn et al.

(10) Patent No.: US 8,205,662 B2
(45) Date of Patent: Jun. 26, 2012

(54) METHOD FOR THE CONTINUOUS CASTING OF A METAL STRAND

(75) Inventors: Albrecht Girgensohn, Düsseldorf (DE); Lothar Schaps, Heinsberg (DE); Uwe Plociennik, Ratingen (DE)

(73) Assignee: SMS Demag Aktiengesellschaft, Duesseldorf (DE)

( * ) Notice: Subject to any disclaimer, the term of this patent is extended or adjusted under 35 U.S.C. 154(b) by 182 days.

(21) Appl. No.: 12/441,417

(22) PCT Filed: Aug. 16, 2007

(86) PCT No.: PCT/EP2007/007204

§ 371 (c)(1), (2), (4) Date: Mar. 16, 2009

(87) PCT Pub. No.: WO2008/034500

PCT Pub. Date: Mar. 27, 2008

(65) Prior Publication Data

US 2010/0051226 A1 Mar. 4, 2010

(30) Foreign Application Priority Data

Sep. 19, 2006 (DE) ..... 10 2006 043 797

(51) Int. Cl.
*B22D 11/20* (2006.01)
*B22D 11/08* (2006.01)

(52) U.S. Cl. ..... 164/454; 164/426

(58) Field of Classification Search ..... 164/425–426, 164/445–446, 454, 452
See application file for complete search history.

(56) References Cited

U.S. PATENT DOCUMENTS

| | | | | | |
|---|---|---|---|---|---|
| 1,894,819 | A | * | 1/1933 | Frank et al. | 420/12 |
| 3,812,900 | A | * | 5/1974 | Bollig et al. | 164/454 |
| 3,889,740 | A | * | 6/1975 | Tarmann et al. | 164/426 |
| 3,983,631 | A | | 10/1976 | Dutzler | 33/143 |
| 4,295,278 | A | | 10/1981 | Gloor | 33/182 |
| 4,344,232 | A | | 8/1982 | Kihlstrom | 33/143 |
| 4,378,464 | A | | 3/1983 | Marmignon et al. | |
| 5,404,931 | A | * | 4/1995 | Anzai et al. | 164/420 |

FOREIGN PATENT DOCUMENTS

| | | |
|---|---|---|
| EP | 1486275 | 12/2004 |
| EP | 1543900 | 6/2005 |
| JP | 55068162 | 5/1980 |
| JP | 57001554 | 1/1982 |
| JP | 57088958 | 6/1982 |
| JP | 62207550 | 9/1987 |
| JP | 06307937 | 11/1994 |

(Continued)

*Primary Examiner* — Jessica L Ward
*Assistant Examiner* — Jacky Yuen
(74) *Attorney, Agent, or Firm* — Andrew Wilford

(57) ABSTRACT

The invention relates to a method for the continuous casting of a metal strand (1), in which the cast strand (1) leaves a die (2) vertically or arcuately downwards and is subsequently guided in a strand guide (3), wherein the strand guide (3) has a number of pairs of rollers (4), which define between them an adjustable roller nip (5), and wherein, at the start of casting, to close the die (2) in the downward direction, a piece of strand (6) is introduced into the die (2) and is followed by the cast strand (1). In order to improve the adjustment of the roller nip, the invention provides that the piece of strand (6), which is produced with a defined or calibrated thickness (d), is inserted between the respective pairs of rollers to calibrate and/or measure the roller nip (5).

8 Claims, 2 Drawing Sheets

FOREIGN PATENT DOCUMENTS

| | | | | |
|---|---|---|---|---|
| JP | 08300122 | A | | 11/1996 |
| JP | 09224508 | A | | 9/1997 |
| JP | 09267159 | | | 10/1997 |
| JP | 10185505 | | | 7/1998 |
| JP | 11028558 | A | * | 2/1999 |
| JP | 2001071103 | A | | 3/2001 |
| JP | 2003112240 | | | 4/2003 |
| JP | 2005349423 | A | | 12/2005 |
| KR | 1020010048624 | | | 1/2001 |
| RU | 2062817 | C1 | | 6/1996 |
| WO | WO-0027566 | | | 5/2000 |

* cited by examiner

METHOD FOR THE CONTINUOUS CASTING OF A METAL STRAND

CROSS REFERENCE TO RELATED APPLICATIONS

This application is the US national stage of PCT application PCT/EP2007/007204, filed 16 Aug. 2007, published 27 Mar. 2008 as WO2008/034500, and claiming the priority of German patent application 102006043797.7 itself filed 19 Sep. 2006, whose entire disclosures are herewith incorporated by reference.

FIELD OF THE INVENTION

The invention relates to a method of continuously casting a metal strand in which the cast strand leaves a mold vertically or in a downward arc and is subsequently guided in a strand guide that has a plurality of roll pairs that define an adjustable roller nip between themselves and in which, at the start of casting, in order to downwardly close the mold a dummy bar is inserted into the mold and is followed by the cast strand.

BACKGROUND OF THE INVENTION

Elevated requirements on the internal quality of strand-cast starting products such as, for example, slab ingots, cogged ingots or billets require that continuous-casting systems be equipped with elements that reduce the strand thickness (for example with appropriate rolls) and that preferably act in the area of the end solidification (so-called soft reduction). Here, for example, the downstream elements of the slab-ingot continuous-casting systems are equipped with position- and/or force-regulated adjustable hydraulic cylinders. On the other hand, in the case of billet systems or bloom systems the drivers downstream of the roll assemblies are used to reduce the strand thickness.

Strict requirements must be placed on the precision of the individual reduction steps in order to be able to achieve good reproducible quality results. This is especially true when the particular shaping elements are adjusted in a position-regulated manner. In this instance a tolerance for the position of the individual rolls of approximately 1/10 mm must be maintained. While it is technically readily possible to position the hydraulic cylinders for actuating the rolls with an appropriate precision, there are different possibilities of error in the case of other structural components required for transmitting the shaping forces.

In this regard the diameter of the strand-guide rolls and/or driver rolls used to shape the strand is especially problematic. The rolls are continuously in contact with the hot strand faces so they are subject to relatively high wear that can vary from roll to roll according to the environmental conditions (temperature, adjusting force, drive torque). In the extreme instance the roll wear can amount to a few millimeters of diameter. Furthermore, it varies over the length of roll. Thus, even the shape actually transmitted onto the metal strand varies, considered over a rather long time period and under conditions that are otherwise the same, so that the quality results obtained cannot be reproduced.

In order to avoid these problems, it is known to recalibrate the strand-guide rolls and/or drive rolls at predetermined intervals. To this end a test piece (test ingot) with known dimensions is run through the roll assemblies and precisely positioned customarily either in the system or on an external test stand. The roll pair or the driver is subsequently closed, so that the rolls rest on the test piece and a predetermined force is applied by the hydraulic cylinders. The measured cylinder position (and therewith also the roll position) can calculated from the known thickness of the test piece for a difference. The test pieces used for this can be designed according to the geometric relationships either as a separate part or can be mounted on the cold strand for the calibration.

EP 1 543 900 teaches a method of basic adjustment and monitoring of the roll nip of support roll assemblies or driver roll pairs in a continuous-casting machine for the casting of liquid metals in which the roll nip between opposite fixed and movable support rolls is measured and regulated via paired hydraulic piston-cylinder units with integrated electronic path- or position transmitters. The actual values are evaluated in a control circuit of the control for the forces to be periodically transmitted to the casting strand. For precise calibration of the roll nip a calibration piece comprising is moved through at least one roll pair of the open roll nip and clamped for a short time during the transport movement between two opposing support rolls, the positions of the piston-cylinder units associated with the clamping positions are stored with measuring technology, and the positions of the piston-cylinder units are corrected after a set-point/actual-value comparison before the start of casting or during a pause in casting.

A similar solution is described by EP 1 486 275, where a fixed roll assembly lower frame and a movable roll assembly upper frame that carry rolls are pressed against one another with a predetermined force of the hydraulic piston-cylinder units with paired distance pieces with a pre-calculated thickness outside of the roll nip between roll assembly upper frame and roll assembly lower frame, and that the associated actual values are determined by the path- or position detectors.

Similar solutions in which a test slab ingot used as a calibration piece is used are known, for example, from EP 0 047 919, DE 699 06 118, JP 0926 7159, JP 2003 112 240, KR 10200 1004 8624, JP 5700 1554, JP 0630 7937, and from JP 0308 6360.

All the above-described solutions have the disadvantage that the method of calibrating and measuring the nip between the rolls is relatively time-consuming, so that it is carried out only relatively infrequently for economic reasons. There is the problem here that in the interval between two calibrations or measurements the rolls of a roll assembly wear down further, so that the actual reduction of the thickness of the strand deviates from the adjusted values.

OBJECT OF THE INVENTION

The object of the invention is therefore to further develop a process of the above-described type in such a manner that the possibility is created with low cost of rapidly compensating the deviation of roll geometry caused by wear, which makes possible the casting of a metal strand with high quality. Thus, the invention compensates for wear of the rolls with low additional cost and optimizes the quality of the cast product.

SUMMARY OF THE INVENTION

This problem is solved in accordance with the invention in that a dummy bar with a predetermined and calibrated thickness is used for calibrating and/or measuring the roll nip between the roll pairs.

Only one section of the dummy bar determined in the travel direction of the metal strand is used for calibration or measuring.

The dummy bar used for calibration or measuring can be separated after the solidification of the metal again, that is, after the hardening of the melt. This results in the possibility multiple reuse of the same dummy bar, that is, the dummy bar is used to cast a plurality of strands.

In order that the dummy bar is especially well suited for a precise calibration when reused repeatedly, a further development provides that the dummy bar is hardened on its faces engaging the rolls of the roll assembly.

This goal can also be better achieved in that the dummy bar is provided on the faces engaging the rolls of the roll assemblies with a coating. The coating is preferably designed to be wear-resistant, to which end known hard but temperature-stable coating materials can be used.

The dimension of the roll nip between the roll pairs can be measured and stored at every casting start or according to requirements. In accordance with a further development adjustment of the roll nip between the particular roll pairs is not performed until the actual value or the roll nip exceeds a desired value.

During the calibration and measuring the rolls of the roll assemblies are preferably pressed with a predetermined force on faces of the dummy bar.

The actual roll diameter and therewith also the roll nip can be measured sufficiently often with the suggested process that deviations resulting from wear can be recognized soon and be compensated out. The expense for this is low and permits frequent repetition of the calibration and measuring as well as an adaptation of the geometric parameters as a function of the wear that occurred on the rolls.

According to the invention the dummy bar used for this purpose is the one that closes the mold at the bottom at the start of casting, connects with the hot strand, is transported at the start of casting through the system and is separated again from the warm strand at the end of the strand guide. Instead of a separate part or calibration piece, as suggested in the state of the art, that is mounted for the calibration on the dummy bar, a predetermined section of the dummy bar can therefore be used at each pass of the dummy bar through the strand guide for determining the actual differences, namely, for the rolls resting on the dummy bar. These rolls are preferably pressed with a predetermined force against the dummy bar, which is necessary in any case to convey the strand. The position of the adjusting cylinders of the rolls against the strand can be measured sufficiently precisely.

As mentioned above, the corresponding section of the dummy bar can be protected against deformation, corrosion and wear, e.g. by hardening and/or by coating its faces in order that its geometry does not change over time—not even in the case of multiple use of the dummy bar.

According to a further development, the differences determined preferably for all rolls in engagement are stored at each passage of the dummy bar, which makes it possible to continuously monitor roll wear. A changing of the differences is not necessary until predetermined limits, e.g. 0.1 millimeter, are exceeded. However, it is of course also possible that the determined differences are automatically evaluated at each passage of the dummy bar, that is, the rolls are appropriately adjusted.

BRIEF DESCRIPTION OF THE DRAWING

The drawings show an illustrated embodiment of the invention. Therein:

FIG. 2 is a side view a support roll assembly when a dummy bar is passing through.

DETAILED DESCRIPTION

Figure 1:
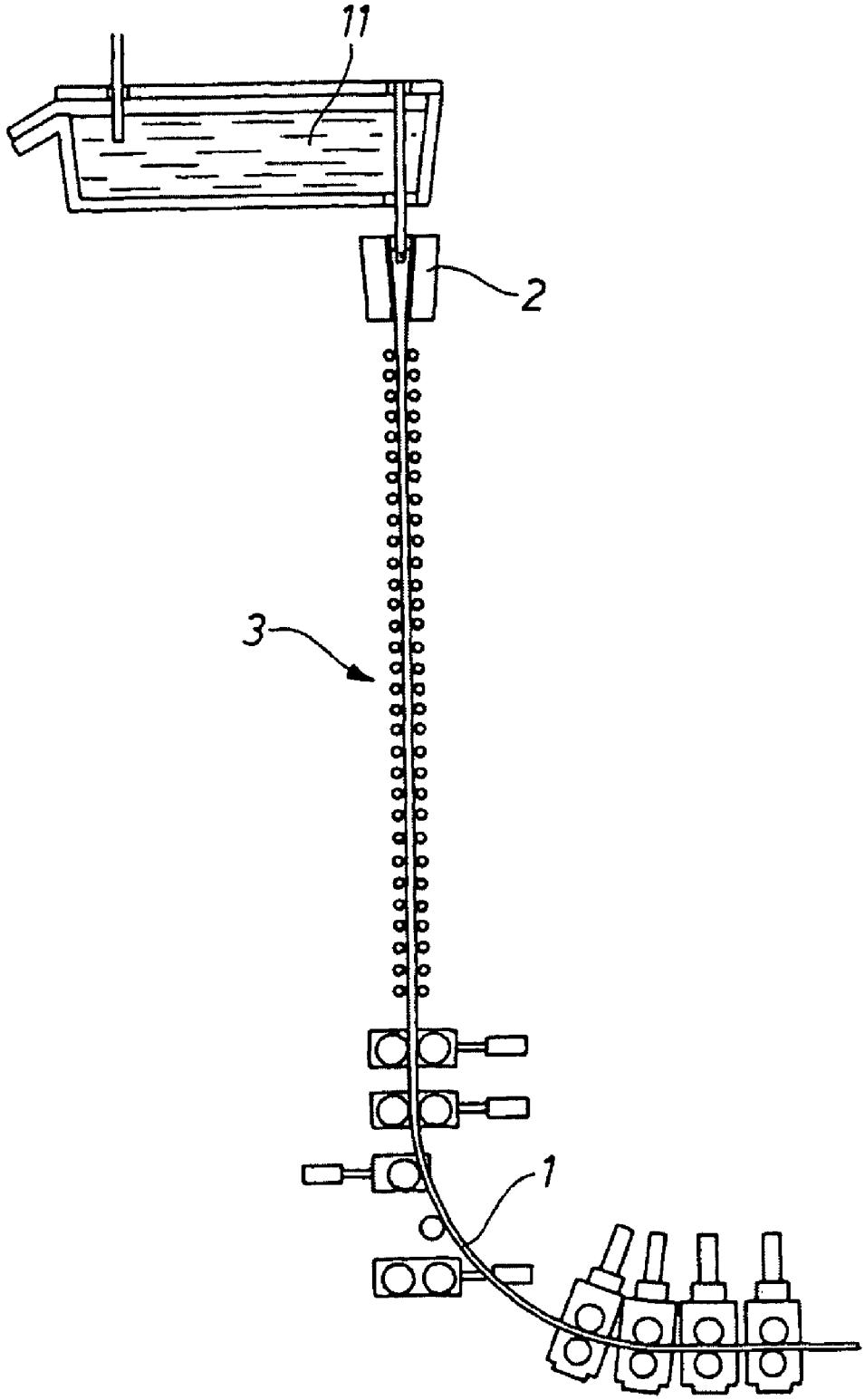
FIG. 1 is a side view of a thin slab-ingot continuous-casting machine.

A continuous-casting system can be seen in the figures with which a metal strand 1 is continuously cast. This strand passes from a supply 11 for liquid steel to a mold 2. Prior to the start of casting, the mold 2 is closed at the bottom by a dummy bar 6 that can be seen in FIG. 2 and that is machined to precise dimensions, for example, the desired final dimension of the strand 1, on its faces that are contacted later by strand guide rolls. Faces 9 and 10 of the dummy bar 6 (see FIG. 2) can be hardened and additionally provided with a coating that makes the dummy bar 6 resistant to wear.

Examples for possible coating are the following: A layer of known hardeners such as WC, Co, $Cr_3C_2$ or of nickel or a nickel compound such as NiCr, NiAl, CuNiIn or also of diamond (C) or ceramic material (e.g. $Al_2O_3$, $3TiO_2$) can be applied at least on the faces 9 and 10. This can be done, for example, by flame spraying or plasma spraying or also electrolytically.

Figure 2:
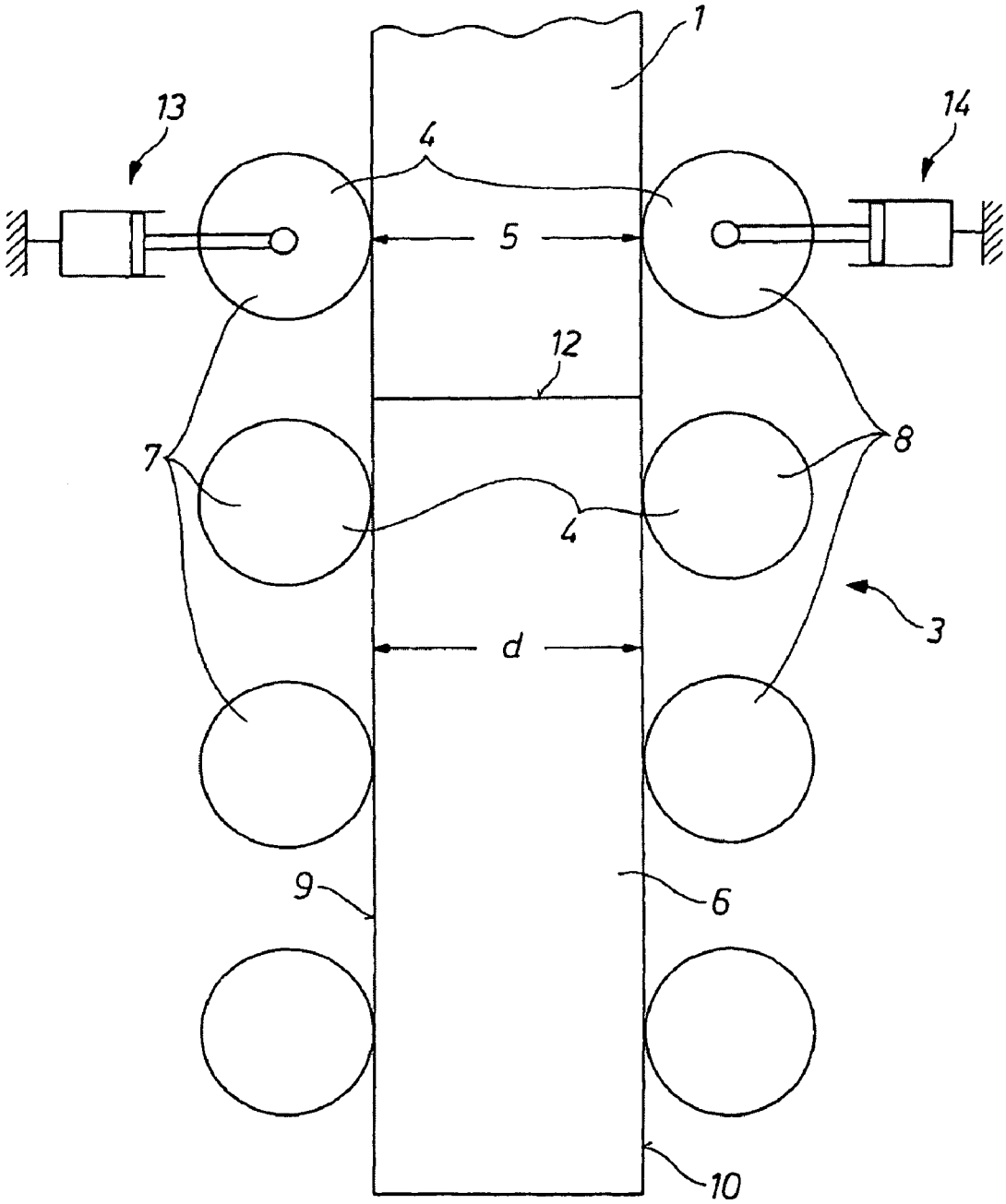

As is apparent from FIG. 2, the continuously cast strand 1 is joined to the dummy bar 6 at an interface 12.

During travel of the dummy bar 6 as well as of the cast metal strand 1 following it through the continuous-casting system, the dummy bar 6 and metal strand 1 are contacted at a strand guide 3 by a plurality of roll pairs 4 on the faces 9 and 10 and guided as a result as well as being gradually bent to move horizontally. The roll pairs 4 comprise rolls 7 and 8 between which a roll nip 5 is defined. The rolls 7 and 8 of a roll pair 4 are pressed perpendicular to the contacted faces of the metal strand 1 by respective hydraulic piston-cylinder actuators 13 and 14 (shown only schematically) in such a manner that the desired roll nip 5 produces a predetermined thickness. Of course, it should be understood here that the desired thickness of the strand 1, which changes on travel through the strand guide 3, is what is meant here.

Since the dummy bar 6 has passed through the entire strand guide 3 at the start of the casting procedure and has a precise manufactured thickness d, the dummy bar 6 serves in accordance with the invention to calibrate the individual roll pairs 4 of the system, i.e. to adjust the size of roll nip 5 of a roll pair 4 so each position of the strand guide 3 has the respective desired value.

In an advantageous manner, no calibrating elements that, independently of the actual casting procedure, are guided through the continuous-casting system in order to perform the calibration of the roll pairs are required for this.

The invention claimed is:

1. A method of continuously casting metal strands, the method comprising the steps of:

a) fitting in an outlet of a mold filled with molten metal a dummy bar having opposite faces that are treated to be wear resistant and that are spaced from each other at a precise spacing and joining a trailing face of the dummy bar to the metal in the mold;

b) feeding the bar downward out of the mold directly into and through nips between successive pairs of rolls with a strand of the molten metal joined to the trailing face of the bar following the bar out of the mold through the nips, c) pressing the rolls of each of the pairs against the faces of the bar and against the strand following the bar to pinch the bar and strand between the pairs of rolls and to guide and shape the strand;

c') detecting the spacing of the rolls as they engage the faces of the dummy bar and positioning them against the strand in accordance with the detected spacing;

d) when the strand following the dummy bar is sufficiently hard, separating the dummy bar from the strand; and e) recirculating the dummy bar to the mold for reuse in a subsequent continuous-casting operation.

2. The continuous-casting method defined in claim 1 wherein the bar is treated to be wear resistant by providing the faces with a wear-resistant coating.

3. The continuous-casting method defined in claim 1 wherein the bar is treated to be wear resistant by hardening the faces.

4. A method of continuously casting metal strands, the method comprising the steps of:

a) fitting in an outlet of a mold filled with molten metal a dummy bar having opposite faces that are treated to be wear resistant and that are spaced from each other at a precise spacing and joining a trailing face of the dummy bar to the metal in the mold;

b) moving the bar downward out of the mold through nips of pairs of rolls with a strand of the molten metal joined to the trailing face of the bar following the bar out of the mold through the nips;

c) pressing the rolls of each of the pairs against the faces of the bar and against the strand following the bar to pinch the bar and strand between the pairs of rolls and to guide and shape the strand;

c1) when the rolls of at least one roll pair are pressed against a predetermined portion of the bar, detecting the width of the respective nip and establishing the detected width of the nip as a desired-value nip width;

c2) on engagement of the rolls of the one pair with the strand following the bar, detecting the width of the respective nip and generating an actual-value nip width corresponding thereto;

c3) comparing the generated actual-value nip width with the desired-value nip width;

c4) on deviation of the generated actual-value nip width from the desired-value nip width, shifting the rolls to compensate for the deviation;

d) when the strand following the dummy bar is sufficiently hard, separating the dummy bar from the strand; and e) recirculating the dummy bar to the mold for reuse in a subsequent continuous-casting operation.

5. The continuous-casting method defined in claim 4 wherein the rolls are only shifted when the deviation exceeds a predetermined limit.

6. The continuous-casting method defined in claim 5 wherein the predetermined limit is 0.1 mm.

7. The continuous-casting method defined in claim 1 wherein steps a) through e) are repeated for each subsequent strand-forming operation.

8. The continuous-casting method defined in claim 1 wherein the rolls are pressed with a predetermined force against the faces of the dummy bar.

* * * * *